US009765469B2

(12) United States Patent
Ficke et al.

(10) Patent No.: US 9,765,469 B2
(45) Date of Patent: Sep. 19, 2017

(54) LAUNDRY TREATING APPLIANCE WITH REMOTELY CONTROLLED AIRFLOW AND METHOD OF OPERATING THE SAME

(71) Applicant: Whirlpool Corporation, Benton Harbor, MI (US)

(72) Inventors: Steven D. Ficke, Stevensville, MI (US); Gregory T. Heine, Saint Joseph, MI (US); Gregory S. Lieto, Grand Haven, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 644 days.

(21) Appl. No.: 13/938,449

(22) Filed: Jul. 10, 2013

(65) Prior Publication Data

US 2015/0013074 A1 Jan. 15, 2015

(51) Int. Cl.

| | |
|---|---|
| ***D06F 33/00*** | (2006.01) |
| ***D06F 39/00*** | (2006.01) |
| ***D06F 33/02*** | (2006.01) |
| *D06F 25/00* | (2006.01) |

(52) U.S. Cl.

CPC ..... *D06F 39/005* (2013.01); *D06F 33/02* (2013.01); *D06F 25/00* (2013.01); *D06F 2204/06* (2013.01); *D06F 2204/10* (2013.01); *D06F 2212/02* (2013.01); *D06F 2232/10* (2013.01)

(58) Field of Classification Search

CPC ..... D06F 2058/2819; D06F 2058/2864; D06F 2202/12; D06F 2204/04; D06F 2204/06; D06F 2204/10; D06F 2212/02; D06F 2232/10; D06F 35/00; D06F 35/007; D06F 35/008; D06F 58/10; D06F 58/203; D06F 2219/2633; D06F 2219/2642

See application file for complete search history.

(56) References Cited

U.S. PATENT DOCUMENTS

2003/0028258 A1* 2/2003 Peterson ..... D06F 33/02 700/11
2005/0262883 A1* 12/2005 Yang ..... D06F 39/00 68/12.01
2008/0053163 A1 3/2008 Park et al.
(Continued)

FOREIGN PATENT DOCUMENTS

DE 29622066 U1 4/1998
DE 102004021019 A1 11/2005
(Continued)

OTHER PUBLICATIONS

English Machine Translation of KR20050066329 (Lee et al. 2005).*
(Continued)

*Primary Examiner* — Joseph L Perrin
*Assistant Examiner* — Irina Graf

(57) ABSTRACT

The souring of wet laundry in a laundry treating appliance may be retarded by sending an alert signal indicative of an ending of a cycle of operation from the laundry treating appliance to a remote electronic device. The appliance may receive an authorization signal from the electronic device indicative of an instruction to execute an anti-sour cycle. An anti-sour cycle comprising the energizing of a fan to flow air through a laundry treating chamber may be automatically initiated for the laundry treating appliance.

17 Claims, 5 Drawing Sheets

(56) References Cited

U.S. PATENT DOCUMENTS

| | | | | |
|---|---|---|---|---|
| 2009/0071032 | A1 | 3/2009 | Kreutzfeldt et al. | |
| 2010/0146712 | A1* | 6/2010 | Finch | G06Q 50/06 8/137 |
| 2011/0041562 | A1 | 2/2011 | Balinski et al. | |
| 2013/0321136 | A1* | 12/2013 | Park | D06F 33/02 340/12.54 |

FOREIGN PATENT DOCUMENTS

| | | | | |
|---|---|---|---|---|
| DE | 102007041875 | A1 | 7/2008 | |
| DE | 102010039182 | A1 | 2/2012 | |
| EP | 2050863 | A1 | 4/2009 | |
| EP | 1852543 | B1 | 2/2010 | |
| KR | 20050066329 | A * | 6/2005 | D06F 33/02 |
| WO | 2013066857 | A1 | 5/2013 | |

OTHER PUBLICATIONS

Samsung Smart Washer & Dryer User Manual DV457, Cell Phone App, Date Unkown, http://itunes.apple.com/tr/app/samsung-smart-washer-dryer/id519077318?mt=8.

German Search Report for Counterpart DE102014107910.8, dated Dec. 8, 2014.

* cited by examiner

LAUNDRY TREATING APPLIANCE WITH REMOTELY CONTROLLED AIRFLOW AND METHOD OF OPERATING THE SAME

BACKGROUND OF THE INVENTION

Laundry treating appliances, such as clothes washers, may have a rotating drum defining a treating chamber in which laundry items may be placed for treating according to a cycle of operation. After completion of the cycle of operation, moisture may remain in the laundry and/or within the treating chamber. Moisture-laden laundry items in the treating chamber may induce the formation of mold or mildew, which may create a sour smell that most users find unpleasant. A user may be prevented from immediately removing moisture-laden laundry from the appliance at the end of a cycle of operation, thereby posing a risk of mold or mildew formation, and an ensuing sour smell.

BRIEF DESCRIPTION OF THE INVENTION

The souring of wet laundry in a laundry treating appliance may be retarded by sending an alert signal indicative of an ending of a cycle of operation from the laundry treating appliance to a remote electronic device. The appliance may receive an authorization signal from the electronic device indicative of an instruction to execute an anti-sour cycle. An anti-sour cycle comprising the energizing of a fan to flow air through a laundry treating chamber may be automatically initiated for the laundry treating appliance.

DESCRIPTION OF EMBODIMENTS OF THE INVENTION

Figure 1:
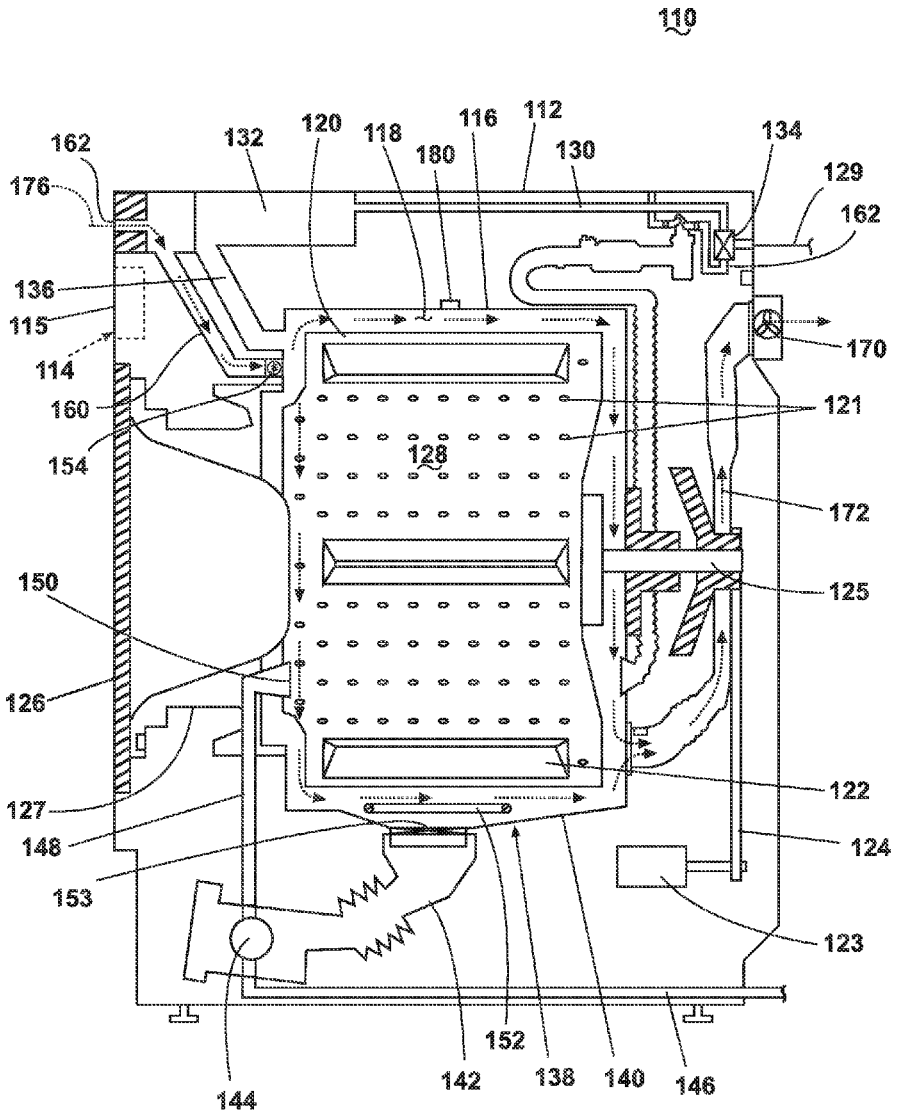
FIG. 1 is a schematic view of a laundry treating appliance according to an exemplary embodiment of the invention.

Referring to the drawings, and particularly to FIG. 1, an embodiment of a laundry treating appliance 110 according to the invention is illustrated. The laundry treating appliance 110 may be any appliance that may perform a cycle of operation on laundry, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. An exemplary embodiment of the invention is described herein with respect to the laundry treating appliance 110 as a washing machine. The washing machine 110 described herein may share many features of a traditional automatic washing machine, which will not be described further except as necessary for a complete understanding of the invention.

Pursuant to the invention, an optional anti-sour cycle (also referred to as an airflow step) may be selected and controlled by a remotely-located appliance user to reduce the level of humidity in the washing machine 110 after completion of a cycle of operation, thereby controlling the growth of mold and mildew, and attendant odors, in damp laundry. The anti-sour cycle may be initiated by the transmission of an alert signal from the washing machine 110 to a remote electronic device, (not shown), more fully described hereinafter, and the return transmission of an authorization signal from the remote electronic device to the washing machine 110 in response to the alert signal. Thus, an exemplary embodiment of the washing machine 110 may include a cabinet 112 enclosing a controller 114 that may receive input from an appliance user through a user interface 115 and the remote electronic device. As hereinafter described, the controller 114 may be electrically coupled with the Internet to define a remote communication and control system for the anti-sour cycle.

A stationary tub 116 may be located within the cabinet 112 and may define an interior chamber 118. A rotatable drum 120 may be located within the interior chamber 118 and may include a plurality of perforations 121 therethrough. Liquid may flow between the tub 116 and the drum 120 through the perforations 121. The drum 120 may further include one or more lifters or baffles 122 disposed on an inner surface of the drum 120 to lift fabric items contained in the drum 120 while the drum 120 rotates. The drum 120 may define a treating chamber 128 for receiving fabric items to be cleaned.

The drum 120 may be rotated by a suitable drive mechanism, which is illustrated as a motor 123 coupled to the drum 120 through a belt 124 and a drive shaft 125. The motor 123 may be operably coupled to the controller 114 to control the rotation of the drum 120 to complete a cycle of operation. Other drive mechanisms, such as direct drive, may also be used.

Both the tub 116 and the drum 120 may be selectively closed by a door 126. A bellows 127 may couple an open face of the tub 116 with the cabinet 112, and the door 126 may seal against the bellows 127 when the door 126 closes the tub 116.

While the drum 120 is illustrated and described herein as defining the treating chamber 128 for receiving fabric items to be treated, the tub 116 and/or the drum 120 may be considered a receptacle, with either of them defining the treating chamber 128. While the illustrated washing machine 110 includes both the tub 116 and the drum 120, it is within the scope of the invention for the laundry treating appliance to include only one receptacle, with the receptacle defining the treating chamber 128 for receiving the fabric items to be treated.

The washing machine 110 of FIG. 1 may further include a liquid supply and recirculation system. Liquid, such as water or water with a wash aid, may be supplied to the washing machine 110 from a water supply 129, such as a household water supply. A first supply conduit 130 may fluidly couple the water supply 129 to a treatment dispenser 132. An inlet valve 134 may control flow of the liquid from the water supply 129 and through the first supply conduit 130 to the treatment dispenser 132. A dispensing conduit 136 may fluidly couple the treatment dispenser 132 with the tub 116.

Liquid that flows from the treatment dispenser 132 through the flow conduit 136 to the tub 116 typically enters a space between the tub 116 and the drum 120 and may flow by gravity to a sump 138 formed in part by a lower portion 140 of the tub 116. The sump 138 may also be formed by a sump conduit 142 that may fluidly couple the lower portion 140 of the tub 116 to a pump 144.

The pump 144 may direct fluid to a drain conduit 146, which may drain the liquid from the washing machine 110, or to a recirculation conduit 148, which may terminate at a recirculation inlet 150. The recirculation inlet 150 may direct the liquid from the recirculation conduit 148 into the drum 120. The recirculation inlet 150 may introduce the liquid into the drum 120 in any suitable manner, such as by spraying, dripping, or providing a steady flow of the liquid.

The washing machine 110 may include a sump heater 152 which may be located in the sump 138. The sump heater 152 may be any type of heater and is illustrated as a resistive heating element for exemplary purposes. The sump 138 may also include a one-way check valve 153 for draining liquid from the sump 138.

The washing machine 110 may further include an airflow device, an exemplary embodiment of which may be a fan 170, for controlling the flow of air within the treating chamber 128 and removing moisture that may remain in a laundry load. The airflow device 170 may be operated to control the humidity of the air within the treating chamber 128 by venting and/or supplying air from the exterior of the washing machine 110 to the tub 116. Although the airflow device is illustrated as a fan 170, other types of airflow devices may be utilized without diverging from the scope of the invention.

The airflow device 170 may be fluidly coupled with the tub 116 through a first ventilation conduit 172 for venting the interior of the tub 116, including the interior chamber 118 and the treating chamber 128. The treating chamber 128 may be fluidly coupled with the interior chamber 118 through the perforations 121 in the drum 120 so that air may flow between the two chambers 118, 128. A second ventilation conduit 160 may be fluidly coupled with the tub 116 and with a vent 162 open to ambient air. The vent 162, the second ventilation conduit 160, the tub 116, the drum 120, the ventilation conduit 172, and the airflow device 170 may define an air flow path for ambient air drawn into and through the tub 116, and exhausted from the tub 116 to the exterior of the washing machine 110.

The washing machine 110 may include an air heater 154 which may be located in the second ventilation conduit 160. The air heater 154 is illustrated as a resistance-type heating element for exemplary purposes, but other suitable types may be used. The air heater 154 may be located in the second ventilation conduit 160 so that air flowing through the conduit 160 into the drum 120 under the influence of the fan 170 may be heated by the air heater 154. The fan 170 may draw ambient air from the exterior of the washing machine 110 through the vent 162 and the second ventilation conduit 160. Heated airflow 176 may continue into the interior chamber 118 and the treating chamber 128, and may exit through the first ventilation conduit 172 to be exhausted to the exterior of the washing machine 110 under the influence of the airflow device 170.

Alternatively, the airflow device 170 may be operated in reverse so that air may be drawn through the first ventilation conduit 172, into the treating chamber 128, through the second ventilation conduit 160, and out the vent 162. However, the air heater 154 may not be operated since it may otherwise be heating air that immediately flows out through the vent 162.

It is within the scope of the invention to utilize more than one airflow device, both intermittently and concurrently. For example, in addition to the airflow device 170 illustrated in FIG. 1, a second airflow device (not shown) may be located in the second ventilation conduit 160 to augment the airflow drawn by the single airflow device 170 through the vent 162 and the treating chamber 128. Additional airflow devices may be combined with an air heater, and may be located to provide an optimal airflow path. Optimal control of airflow through the washing machine 110 may be achieved by selectively operating a selected number of available airflow devices, or operating one or more airflow devices by employing on/off intervals.

Figure 2:
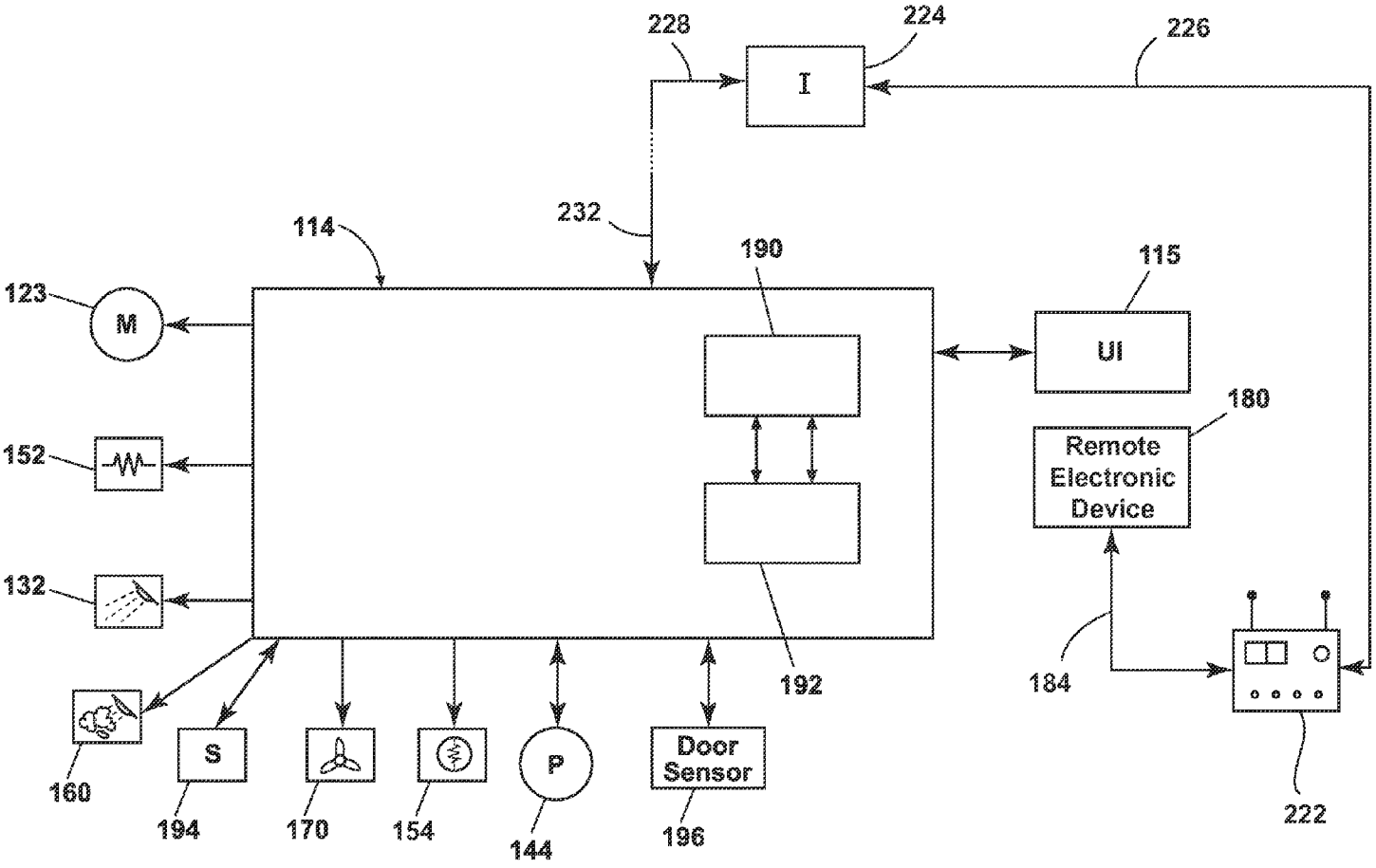
FIG. 2 is a schematic view of a control system of the laundry treating appliance of FIG. 1, including a controller coupled with the Internet for communication with a remote electronic device.

As illustrated in FIG. 2, the controller 114 may be provided with a memory 190 and a central processing unit (CPU) 192. The controller 114 may be operably coupled with one or more components of the washing machine 110 for communicating with and controlling the functioning of the components to complete a cycle of operation. For example, the controller 114 may be coupled with the motor 123 for controlling the direction and speed of rotation of the drum 120; the treatment dispenser 132 for dispensing a treatment aid during a cycle of operation; the sump heater 152 for heating the wash liquid; the pump 144 for recycling liquid from the sump 38 to the drum 120; the airflow device 170 for venting the tub 116; and the air heater 154 for heating air flowing into the tub 116. The controller 114 may be coupled with the user interface 115 for receiving user-selected inputs and communicating information to the user.

The controller 114 may be communicably coupled with and receive input from one or more generally known sensors 194 that may monitor the performance of the washing machine 110. Non-limiting examples of sensors 194 may include one or more of a treating chamber temperature sensor, a moisture sensor, a load size sensor, and a motor torque sensor.

In addition to permanently storing washing machine 110 control software that may be utilized by the CPU 192 to complete a cycle of operation, the memory 190 may temporarily store data from one or more sensors that may be utilized in controlling a cycle of operation. The controller memory 190 may also store software for facilitating communication between the controller 114 and a remote electronic device, in particular, software for establishing and maintaining Internet communication.

Figure 3:
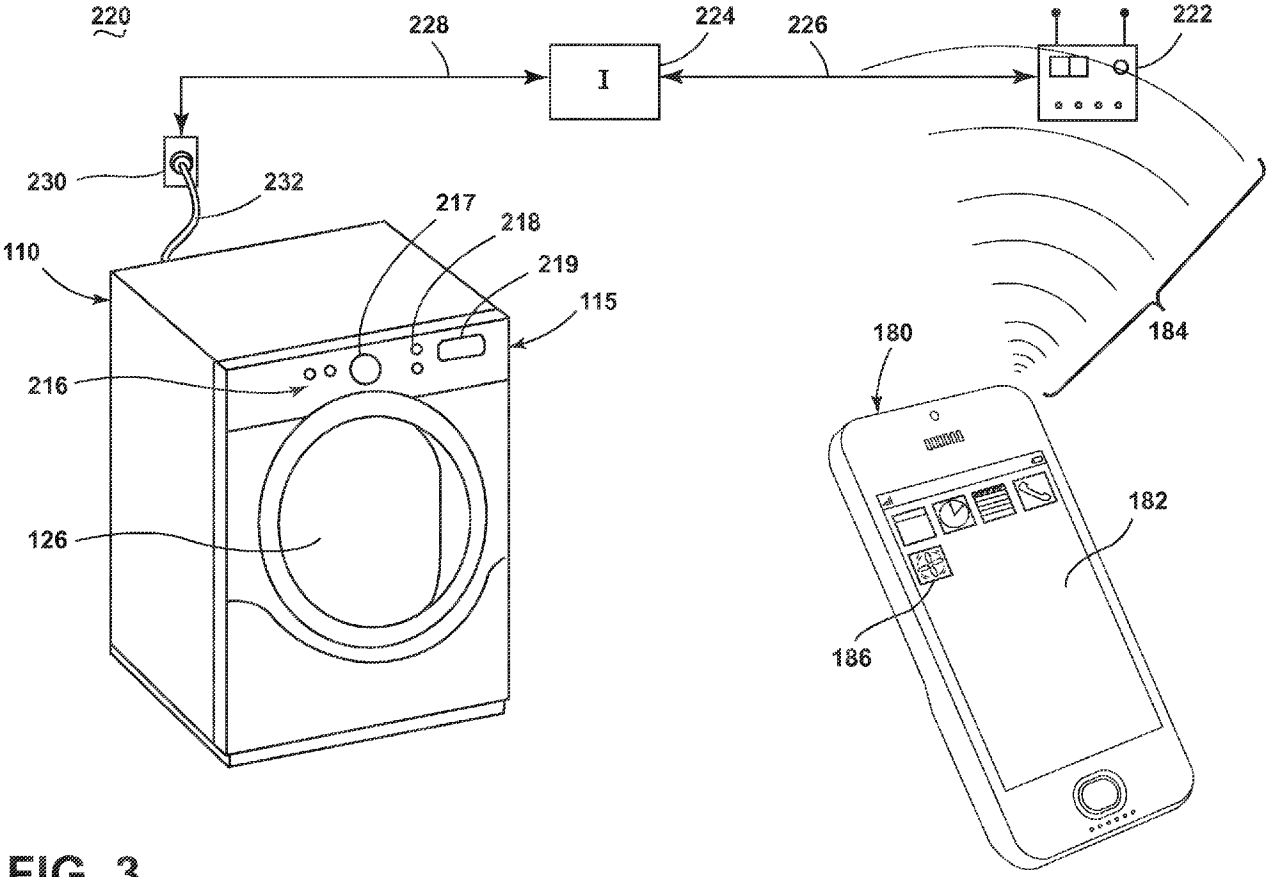
FIG. 3 is a partially schematic view of the control system of FIG. 2 including a remote electronic device in the form of a mobile smartphone having a selectable mobile application for controlling the operation of the laundry treating appliance.

Referring also to FIG. 3, the user interface 115 may include known devices 216, such as buttons, switches, touch panels, and displays, for selecting and monitoring wash liquid temperature 219, spin speed, special cycles of operation 217, wash cycle duration 219, and the like, and may enable selection of the anti-sour cycle 218. The controller 114 may be communicably coupled with a remote electronic device 180 such as a smartphone, a cell phone, a tablet, a laptop computer, and the like. The remote electronic device 180 may include circuitry and software to enable the device 180 to communicate with the controller 114 concerning the operations of the washing machine 110 and its selected components, such as the airflow device 170 and the drum 120. The controller 114 and the remote electronic device 180 may be communicably coupled through an Internet-based wireless communication system.

For example, a remote communication and control system 220 may include the controller 114 electrically coupled with an Internet service provider (ISP) 224 through known communication lines 232, 228, such as Ethernet network cables, shielded coaxial cables, telephone lines, fiber-optics lines, and the like. The ISP 224 may provide Internet access to a device, such as a wireless router 222 that is coupled through a communication line 226 with the ISP 224. The wireless router 222 may be remotely located from the controller 114, for example, at an Internet café, a workplace, a municipal office, a sports arena, a grocery store, or any other place providing wireless Internet access.

The wireless router 222 may communicate with the ISP 224 through the communication line 226, and the ISP 224 may communicate with the controller 114 through the communication line 228 that may be electrically coupled in a known manner with a cable jack 230, or similar connection. The washing machine 110 may include a communication line 232 coupled with the controller 114 that can be joined with the cable jack 230 to establish the complete remote communication and control system 220. Communication between the remote electronic device 180 and the controller 114 may be effected by transmitting a wireless radio signal 184 between the remote electronic device 180 and the wireless router 222.

Alternatively, the controller 114 may be wirelessly coupled with a wireless router (not shown), known also as a residential gateway, similar to the wireless router 222. The router may be coupled in a generally known manner with the ISP 224 through a communication line and cable jack similar to the communication line 232 and cable jack 230 disclosed in FIG. 3. The router may serve a local area network (LAN) in the residential structure in which the washing machine 110 may be located. In addition to home electronics devices, such as computers, televisions, music systems, and the like, the controller 114 may be wirelessly coupled with the LAN via the router to thereby communicate with the ISP 224. Alternatively, a router may be utilized that is dedicated solely to the washing machine 110. Regardless of the manner of utilizing the router, the controller 114 may include a wireless radio signal transmitter (not shown), incorporated into or coupled with the controller 114, for communicating with the router.

The controller 114 may require drivers and/or other software for configuring communication with the router and the LAN, which may be stored in the memory 190 and processed by the CPU 192. The user interface 115, which may include a touch screen, may be utilized to configure communication between the controller 114 and the router. Alternatively, a desktop computer, a laptop computer, a tablet, the remote electronic device 180, and the like, that are part of the LAN, may store and utilize the drivers and/or software for configuring communication between the controller 114 and the router, and wirelessly sending the resulting IP data to the controller 114.

There may be other means of establishing communication between the remote electronic device 180 and the controller 114, and the exemplary embodiments disclosed herein should not be considered a limitation on the claims. For example, the router may be communicably coupled with the controller 114 via a USB interface, an IEEE 1394 interface (FireWire), or other suitable communication interface standards.

FIG. 3 illustrates the remote electronic device 180 as an exemplary smartphone. The smartphone 180 may include software stored in smartphone memory (not shown) in the form of an application for establishing and maintaining Internet communication with the controller 114. The application may be interactively identified on a touch screen 182 by a smartphone icon 186 that may be selected by a user touching the icon 186 to thereby launch the application.

Figure 4:
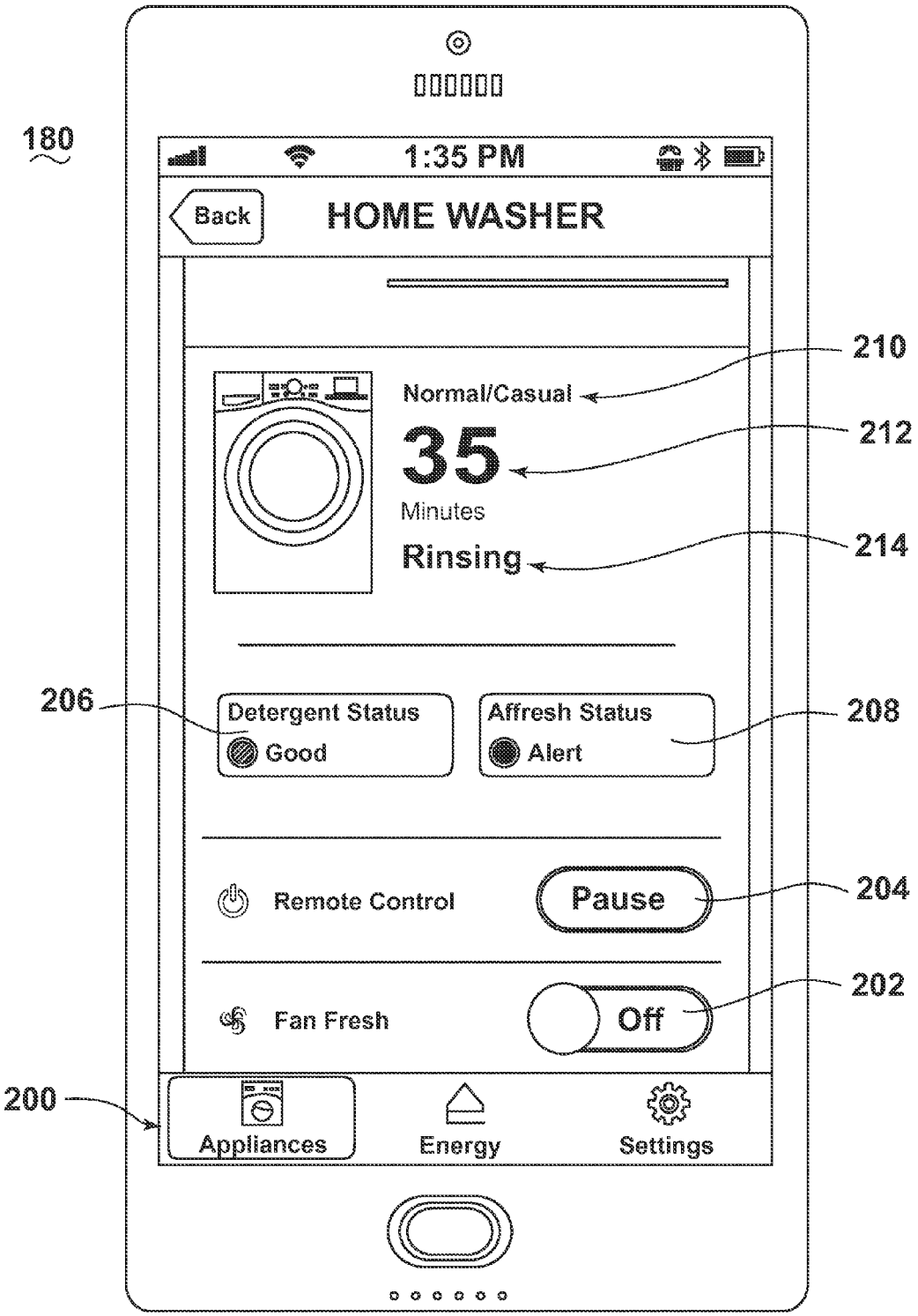
FIG. 4 is an enlarged elevation view of the mobile smartphone of FIG. 3 illustrating exemplary controls and a display of information accessible through the smartphone display.

Referring to FIG. 4, selecting the icon 186 may launch an interactive display on the touch screen 182 that may include one or more functions, and may enable control of the washing machine 110 and a selected cycle of operation through use of the remote electronic device 180. For example, the display may include user-selectable categories 200, such as "Appliances," "Energy," and "Settings." Selecting the "Settings" function may enable a user to customize the display, wireless connectivity, and the like. Selecting the "Appliances" function may enable a user to select and control one or more appliances. Selecting the "Energy" function may enable a user to monitor the energy use of one or more appliances, and optimize appliance operations, such as during a low energy use time period, in order to minimize the costs of running an appliance.

In addition to the launch of the interactive display on the touch screen 182 by selection of the icon 186, the authorization signal may be generated by the electronic device 180 merely by selecting the icon 186.

It may be necessary to select the anti-sour cycle prior to the occurrence of a preselected event, such as the completion of a cycle of operation. The anti-sour cycle may be selected by actuating a switch 218 on the user interface 115, or by actuating a touch-screen switch 202 on the smartphone display 182. A user may be able to initiate the anti-sour cycle, even though the user may be away from the washing machine 110, solely by actuating the switch 202 to remotely select the anti-sour cycle. Alternatively, it may be necessary to make the anti-sour cycle available for remote selection by first actuating the switch 218 on the user interface 115 in order to actuate the touch screen switch 202. If the anti-sour cycle is not selected prior to the event, the touch screen switch 202 may be disabled for the current cycle of operation, thereby precluding the selection of the anti-sour cycle.

The display 182 may also include a remote control switch 204 that may enable a user to remotely pause a cycle of operation. Notifiers, such as LEDs or other attention-drawing icons, may inform a user of the status of selected parameters, for example, the type or quantity of a treatment aid, such as detergent 206 or a freshening chemistry 208. If a notifier indicates that an event will occur or has occurred that may require some responsive action on the part of the appliance user, the remote control switch 204 may be actuated to pause the cycle of operation until the event has been addressed.

The display 182 may also include an output of preselected information for a selected appliance identifying, for example, a selected cycle of operation 210 such as normal/casual, heavy duty, delicate, and the like; the time remaining until the end of the cycle of operation, which may provide the appliance user with a timely opportunity to select the anti-sour cycle; and the current status of operation of the appliance, such as pre-wash, soaking, washing, rinsing, spinning, and the like. As illustrated in FIG. 4, the display 182 may show that a normal/casual cycle of operation is currently in progress, 35 minutes remain until the end of the cycle of operation, and the cycle of operation is currently in a rinsing step. Thus, the user may be alerted that about 35 minutes remain in which to select an anti-sour cycle. The remaining time may be displayed as a countdown timer having a preprogramed or user-selectable countdown interval, e.g. 1 sec., 0.1 min., 1.0 min., and the like. The electronic device 180 may be programmed to broadcast an alert signal in the form of a status signal. The status signal may include information as displayed in FIG. 4, such as the time remaining for a cycle of operation. Alternatively, the status signal may simply comprise a completion signal indicating completion of the cycle of operation.

It may be understood that the functions and indicators may vary from those illustrated in FIG. 4 based upon such factors as the particular appliance being monitored and controlled, and the type of control desired. For example, an alert signal may be sent by the washing machine 110 only when the anti-sour cycle is selected on the user interface 115. During the anti-sour cycle, either or both unheated air or heated air may flow through the treating chamber 128, and the airflow may be selectably intermittent. The drum 120 may also be rotated to reposition the laundry, and the drum rotation may be intermittent.

Other variations may include the conditions that the authorization signal be received by the washing machine 110 from the remote electronic device 180 prior to the expiration of the countdown timer in order to utilize the anti-sour cycle, or that automatic initiation of an anti-sour cycle may be limited to only instances when the anti-sour cycle is selected on the user interface 115.

Figure 5:
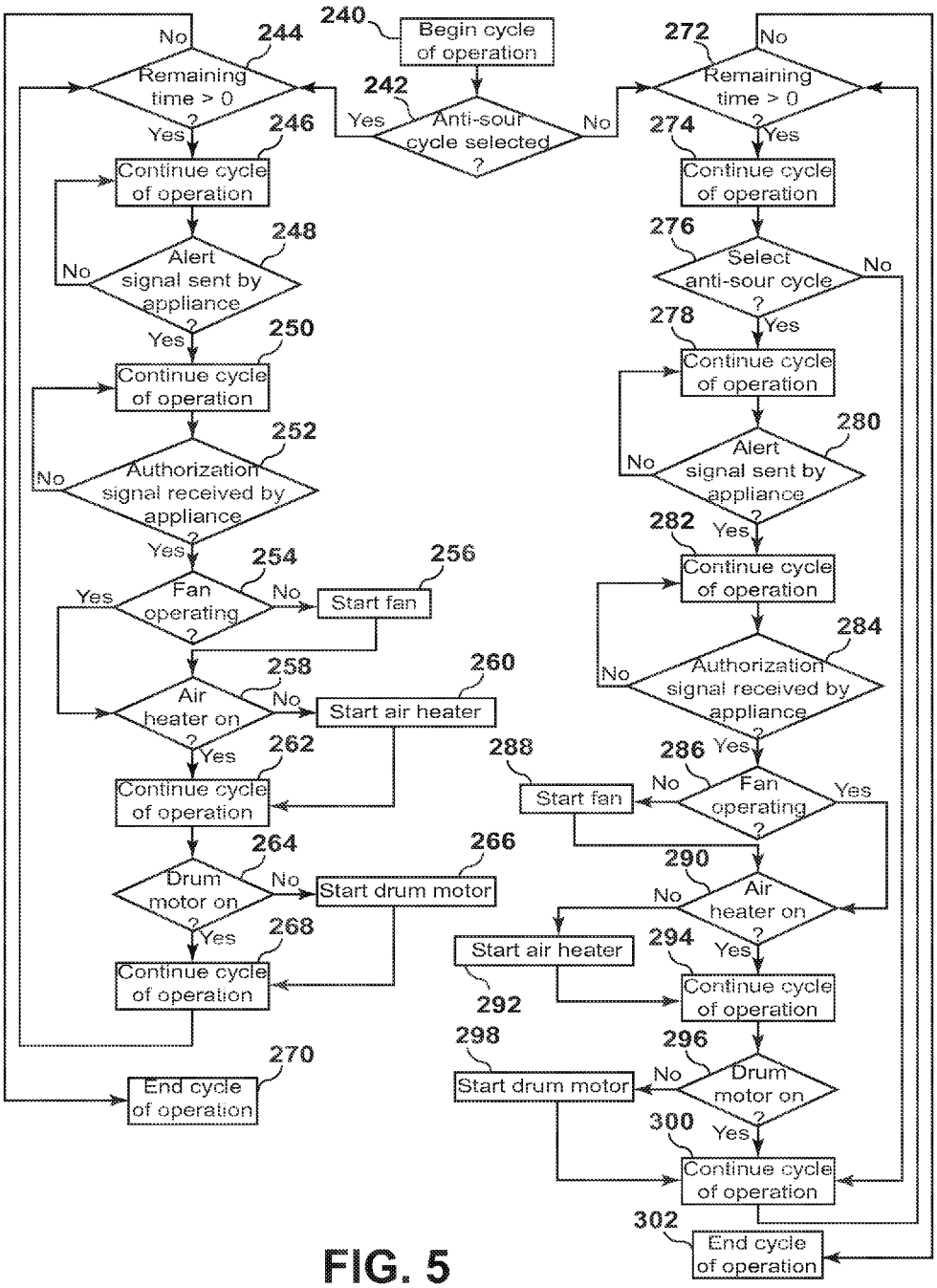
FIG. 5 is an exemplary flow chart of the operation of the control system of FIG. 2 under two alternative scenarios.

FIG. 5 illustrates an exemplary flow chart characterizing two alternative flows of control for an anti-sour cycle. The flow of control, or control flow, may differ primarily based upon whether or not an anti-sour cycle has been selected at the start of a cycle of operation. In each case, the control flow may begin with selecting and initiating a cycle of operation 240, which an appliance user may complete on the user interface 115. This may include the selection of fabric type, wash liquid temperature, number and duration of rinse steps, and the like. The control flow may include an inquiry into whether an anti-sour cycle may have been selected 242. If the anti-sour cycle has been selected, an inquiry may follow into whether the remaining cycle time may be greater than zero 244. If the anti-sour cycle has not been selected, the control flow may address whether the remaining cycle time may be greater than zero 272. The anti-sour cycle may be selected after initiating the cycle of operation (time>0), but before the cycle of operation has ended (time=0).

If the remaining time may not be greater than zero, the control flow may proceed directly to the end of the cycle of operation 270. If the remaining time may be greater than zero, the cycle of operation may continue 246. The control flow may then pass to an inquiry into whether an alert signal may have been sent by the appliance 248. If an alert signal has not been sent, the cycle of operation may continue 246, and the control flow may then pass to an inquiry into whether an alert signal may have been sent 248. This may be repeated until an alert signal has been sent by the appliance. The cycle of operation may continue 250, followed by an inquiry 252 into whether an authorization signal may have been received by the appliance from the remote electronic device 180. If no authorization signal has been received, the cycle of operation may continue 250, followed by a repeat of the immediately prior inquiry. If an authorization signal has been received, the control flow may pass to an inquiry addressed to whether the fan may be operating 254. If it is not, the fan may be started 256. If it is, the control flow may pass to an inquiry addressed to whether the air heater may be on 258. If it is not, the air heater may be started 260. If it is, the cycle of operation may continue 262, followed by an inquiry addressed to whether the drum motor may be on 264. If it is not, the drum motor may be started, followed by continuation of the cycle of operation 268. If the drum motor is on, the cycle of operation may be continued 268. After step 268, the control flow may pass back to step 244 and the inquiry addressed to whether the remaining time may be greater than zero. The control flow may be repeated until the remaining time is not greater than zero, and the control flow may pass from step 244 to the ending of the cycle of operation 270.

The following alternative control flow may be similar to the above-described control flow for an anti-sour cycle selected at the start of a cycle of operation. However, with a cycle of operation initiated, the anti-sour cycle not selected, and the remaining time greater than zero, the cycle of operation may be continued for some variable period of time 274, for example, to a rinse step. Subsequently, the control flow may pass to an inquiry addressed to whether the anti-sour cycle may have been selected 276. If the anti-sour cycle has not been selected, the cycle of operation may continue at 300, followed by an inquiry again addressed to whether the remaining time may be greater than zero 272. If, however, the anti-sour cycle has been selected, the control flow may proceed through the steps of continuing the cycle of operation 278, an inquiry into whether an alert signal may have been sent by the appliance 280, continuing the cycle of operation 282, an inquiry into whether an authorization signal may have been received by the appliance 284, an inquiry into whether the fan may be operating 286, an inquiry into whether the air heater may be on 290, and an inquiry into whether the drum motor may be on 296. Steps may also include a start fan step 288, a start air heater step 292, and a start drum motor step 298. The control flow may pass to continuation of the cycle of operation 300, and ultimately the end of the cycle of operation 302.

The flow chart may also include additional steps, such as whether the drum rotation may be intermittent or continuous; whether flowing of the air may comprise only the flow of unheated air; whether the flow of air may comprise the flow of heated or unheated air without rotation of the drum 120; whether automatically initiating the anti-sour cycle may occur only when the anti-sour cycle is selected on the user interface 115; and whether automatically initiating the anti-sour cycle may occur only when the authorization signal is received by the washing machine 110 before the expiration of the countdown timer.

High relative humidity levels in a treating chamber 128 may contribute to an increase in the growth of microorganisms in a laundry load. On some occasions, the appliance user may forget or be unable to remove the laundry after the completion of a cycle of operation, subjecting the laundry holding in the treating chamber 128 to high relative humidity levels over a substantial period of time. The growth of microorganisms may generate an unpleasant odor that may permeate and remain with the laundry. The growth of microorganisms may also contribute to deterioration of laundry items over time. Operation of the airflow device 170 to draw ambient air into the tub 116 and exhaust the air within the tub 116 to the exterior of the washing machine 110 may decrease the humidity of the environment within the tub 116, thereby discouraging the growth of odor-producing microorganisms. The airflow device 170 may also have an additional benefit of reducing the temperature of the laundry, which may also inhibit the growth of microorganisms.

The activation of the airflow device 170 may be combined with additional tumbling after the completion of the user-selected cycle of operation. Rotation of the drum 120 and tumbling of the laundry load may facilitate evaporation of liquid from the laundry by exposing more of the surface of the laundry. In addition, tumbling of the laundry may discourage microorganism growth by providing an unstable substrate (the laundry fabric) on which many microorganisms find it difficult to propagate. Evaporation of additional liquid from the laundry and subsequent removal of the humid air from the tub 116 by the airflow device 170 may further decrease the growth of odor-causing microorganisms in the laundry.

Tumbling of the laundry load and activation of the airflow device 170 may be employed independently. Alternatively, the tumbling and activation of the airflow device 170 may be coordinated to provide an additive or synergistic effect to discourage the growth of microorganisms. The rate and number of post-cycle rotations of the drum 120 may be set to minimize the potential for mechanical damage to laundry items.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method for retarding souring of wet laundry in a laundry treating appliance having a rotating drum at least partially defining a laundry treating chamber in which laundry is received for treatment according to an automatic cycle of operation, the method comprising:

receiving at a user interface of the appliance a preselection of an authorizable anti-sour cycle to follow the cycle of operation;

initiating the cycle of operation;

where when the preselection has been selected for the cycle of operation at the user interface, sending from the laundry treating appliance to an electronic device remote from the laundry treating appliance, during the cycle of operation, an alert signal indicative of the preselection at the user interface and indicative of an ending of the cycle of operation; and upon receiving an authorization signal to enable the anti-sour cycle from the remote electronic device prior to the ending of the cycle of operation, automatically initiating the anti-sour cycle for the laundry treating appliance comprising energizing of a fan to flow air through the laundry treating chamber, and upon failing to receive the authorization signal from the remote electronic device, not initiating the anti-sour cycle.

2. The method of claim 1 wherein the anti-sour cycle comprises flowing unheated air through the treating chamber.

3. The method of claim 2 wherein the anti-sour cycle comprises rotating the drum to reposition the laundry.

4. The method of claim 3 wherein the rotating the drum is intermittent.

5. The method of claim 2 wherein the flowing of air comprises only the flowing of unheated air through the treating chamber.

6. The method of claim 2 wherein the flowing of air is intermittent.

7. The method of claim 1 wherein the alert signal comprises a status signal for the cycle of operation.

8. The method of claim 7 wherein the status signal comprises a remaining time for the cycle of operation.

9. The method of claim 8 further comprising displaying a countdown timer on the electronic device based on the remaining time.

10. The method of claim 8 wherein the automatically initiating the anti-sour cycle occurs only when the authorization signal is received before expiration of the remaining time.

11. The method of claim 7 wherein the status signal comprises a completion signal for the cycle of operation.

12. The method of claim 1 further comprising receiving the alert signal as input to an application being executed on a processor of the electronic device.

13. The method of claim 12 further comprising generating the authorization signal from the application in response to a user input on the electronic device.

14. The method of claim 1 wherein the laundry treating appliance comprises a clothes washer.

15. The method of claim 14 wherein the laundry treating appliance comprises only a clothes washer.

16. A method for retarding souring of wet laundry in a laundry treating appliance having a rotating drum at least partially defining a laundry treating chamber in which laundry is received for treatment according to an automatic cycle of operation, the method comprising:

receiving at a user interface of the appliance a selection of a preselection of an authorizable anti-sour cycle to follow the cycle of operation;

initiating the cycle of operation;

during the cycle of operation, where when the preselection has been selected for the cycle of operation at the user interface, sending from the laundry treating appliance to an electronic device remote from the laundry treating appliance an alert signal indicative of the preselection at the user interface and indicative of remaining time for the cycle of operation; and upon receiving an authorization signal to enable the anti-sour cycle from the remote electronic device, prior to the expiration of the remaining time, automatically initiating the anti-sour cycle for the laundry treating appliance comprising energizing of a fan to flow air through the laundry treating chamber, and upon failing to receive the authorization signal from the remote electronics device prior to the expiration of the remaining time, not initiating the anti-sour cycle.

17. A method for retarding souring of wet laundry in a laundry treating appliance having a rotating drum at least partially defining a laundry treating chamber in which laundry is received for treatment according to an automatic cycle of operation, the method comprising:

receiving a first confirmation, by the appliance, of a preselection of an authorizable anti-sour cycle to follow the cycle of operation at a user interface of the appliance;

initiating the cycle of operation;

after receiving the first confirmation and during the cycle of operation, sending from the laundry treating appliance to an electronic device remote from the laundry treating appliance an alert signal indicative of the preselection at the user interface and indicative of an ending of the cycle of operation;

receiving a second confirmation of an authorization signal to enable the anti-sour cycle from the remote electronic device, by the appliance; and upon receiving the second confirmation, automatically initiating the anti-sour cycle for the laundry treating appliance comprising energizing of a fan to flow air through the laundry treating chamber, and upon failing to receive the second confirmation, not initiating the anti-sour cycle.

* * * * *